United States Patent [19]

Dogliotti

[11] 4,197,939

[45] Apr. 15, 1980

[54] SHIPPING AND DISPLAYING DEVICE FOR SMALL ARTICLES

[75] Inventor: Amilcare Dogliotti, Alba, Italy

[73] Assignee: P. Ferrero & C. S.p.A., Alba, Italy

[21] Appl. No.: 947

[22] Filed: Jan. 4, 1979

[51] Int. Cl.[2] ..... B65D 5/50; B65D 5/52

[52] U.S. Cl. ..... 206/44 R; 248/174

[58] Field of Search ..... 206/44 R; 248/174

[56] References Cited

U.S. PATENT DOCUMENTS

| | | | |
|---|---|---|---|
| 2,123,290 | 7/1938 | Powers | 248/174 |
| 2,727,619 | 12/1955 | Paige | 206/44 R |
| 2,926,777 | 3/1960 | Maguire | 206/44 R |
| 3,167,179 | 1/1965 | Goldstein | 206/44 R |
| 3,438,508 | 4/1969 | Kuns et al. | 206/44 R |

*Primary Examiner*—William T. Dixson, Jr.

*Attorney, Agent, or Firm*—Sughrue, Rothwell, Mion, Zinn and Macpeak

[57] ABSTRACT

A display device for shipping and displaying small articles, such as candies, including two trays and a display frame. The frame includes a shelf at its mid-section, with an enclosure in the lower portion of the frame, below the shelf. One of the trays is stored on the shelf in full view, while the other tray is stored for subsequent use within the integral enclosure in the frame.

13 Claims, 10 Drawing Figures

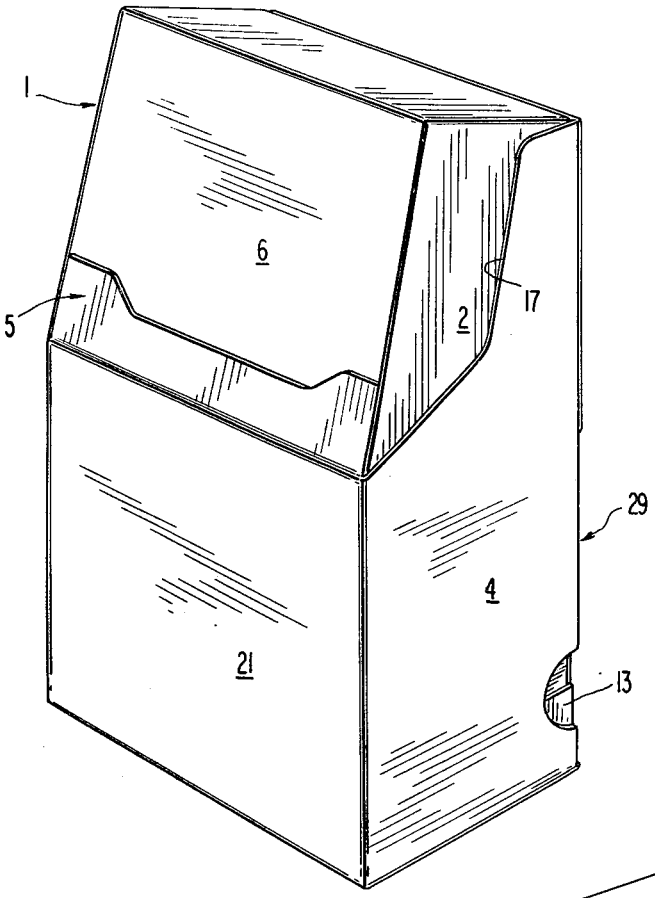
FIG 1
FIG 2
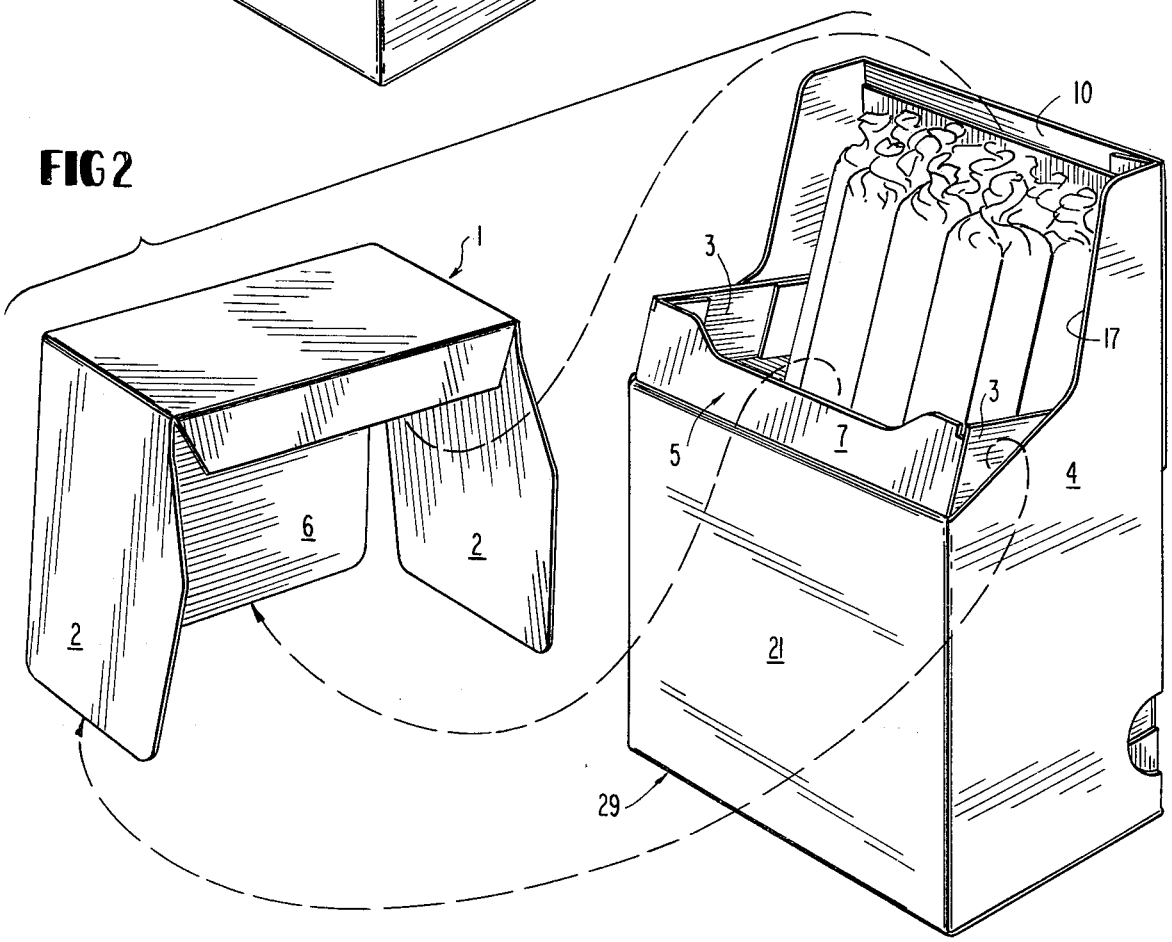

SHIPPING AND DISPLAYING DEVICE FOR SMALL ARTICLES

BACKGROUND OF THE INVENTION

1. Field of the Invention

The present invention relates to improvements in containers that can be used for shipping and storage, as well as displaying of its contents.

2. Description of the Prior Art

Generally, the manufacturer of a product packs, stores and ships the articles in a container designed only for such purposes. These containers are not designed for displaying purposes, and the retailer is faced with the choice of displaying the articles for sale in an unattractive display or unpacking the items and putting them on the shelves. The latter requires additional labor and is more expensive for the merchant.

It is desirable to have a container which is suitable for both shipping and displaying.

To serve this dual purpose, the container must be of sufficient strength and stability to withstand the potentially rough handling frequently encountered in shipping and be sturdy enough to be self-supporting while on display. It is also important that the container be compact and space sufficient because the less space it takes up, the cheaper it will be to ship and store.

Another problem with many display containers is that they display large quantities of the sale item at a time. Consequently, many of the products are damaged or possibly stolen when displayed in these large quantities. If a merchant were to display only a small amount of each item at a time, it would require frequent trips to the storage room for refills. It is thus desirable to display only a small amount of each item, yet have a refill conveniently nearby, eliminating frequent trips to the storage room.

Numerous previous attempts to solve these problems have been made. A typical example of these attempts is found in the following reference.

Richards, U.S. Pat. No. 1,896,721 shows a floor stand with a large open area to place articles for sale. This stand has no enclosed area to store articles.

Another attempt is described in the Gray patent, U.S. Pat. No. 3,653,495, which shows a shipping container that can be converted to a display device. The display area is divided into separate sections, although all the sections are in full view.

A third attempt is seen in the Hardison et al. patent, U.S. Pat. No. 4,000,811, which describes a shipping container that can be stacked on similar containers and cutaway in such a method as to display the contents of the box.

Although these containers have been useful, they have not proven satisfactory under all conditions.

SUMMARY OF THE INVENTION

It is therefore an object of the present invention to provide a frame that allows its contents to be attractively displayed in their original shipping carton.

Another object of the present invention is to provide a display frame that allows large surface areas for advertising.

Accordingly, the present invention includes a frame that displays only a minimum ammount of an article that is necessary at one time, it has a refill tray conveniently stored in the base of the container where it is enclosed and protected. When the display tray is empty, it is a simple matter for the clerk to switch trays and eliminates trips to the storeroom.

The general purpose of this invention includes providing an improved frame that is suitable for shipping and displaying small articles. The improved frame is easily converted from a shipping container to a display device for its contents simply by removing the cellophane wrapper and the protective cardboard cover. In addition, the frame holds two trays, one of which rests on top on the display in full view of customers. A second tray fits in the base of the frame and cannot be seen from the front but can easily be removed from the base and exchanged for the top container when the top container is empty.

The invention comprises a display device having a shelf for displaying a tray of articles and an enclosed area in which one additional tray can be stored. The shelf of this frame begins at the top of the front wall and extends horizontally into the frame. One tray rests upon this shelf and leans against the rear wall. A second tray fits in an enclosure beneath this shelf formed by the front wall, the side walls, the base of the frame and the shelf. The rear wall of the frame begins at the top of the rear wall of the tray that fits in the enclosure, which is near the middle of the frame.

More particularly, the present invention comprises a frame having front, rear and side walls. The bottom wall is formed by flaps extending from the front and side walls. The top half of the front wall folds into the frame to serve as a shelf for the tray that is on display. The shelf is substantially horizontal, preferably tilted back at a slight angle between 0 and 20°. The bottom half of the rear wall is also folded into the frame to support the shelf for the display tray. Folding up the bottom half of the rear wall exposes the lower half of the interior of the frame from the back. A tray, having low front and side walls and a rear wall substantially equal in size to the area exposed at the back of the frame, fits into the opening that was made by folding up the bottom half of the rear wall. The rear wall of the tray, together with the top half of the rear wall of the frame, makes a complete rear wall for the display frame. An identical tray is also placed on the horizontal shelf formed approximately halfway up the frame by folding in the front and rear walls. The rear wall of this tray lies flat against the rear wall of the frame. The side walls of the container are cut back diagonally at the top to better expose the articles in the top tray. Small, semicircular portions of the side walls are cut away near the bottom at the rear edge in order to facilitate removal of the bottom tray. For shipping purposes only, a piece of cardboard may be folded over the top tray and taped in place, and the entire frame is wrapped in cellophane.

BRIEF DESCRIPTION OF THE DRAWINGS

FIG. 1 is a perspective view of a frame of the invention with a protective cardboard cover in place for shipping and storing purposes.

FIG. 2 shows the protective cover removed to expose the display tray.

DESCRIPTION OF THE PREFERRED EMBODIMENT

Figure 3:
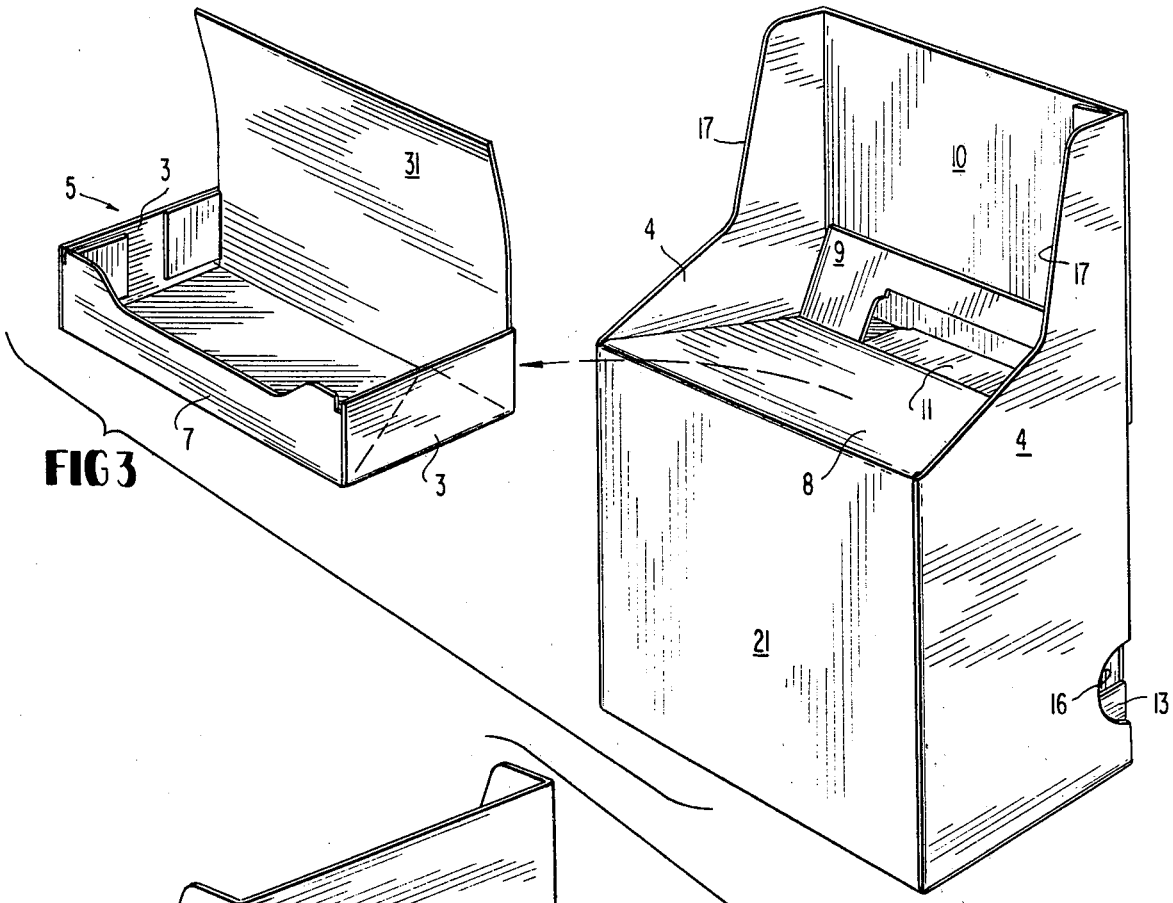
FIG. 3 is a perspective view of the frame illustrating the removal of the display.
Figure 4:
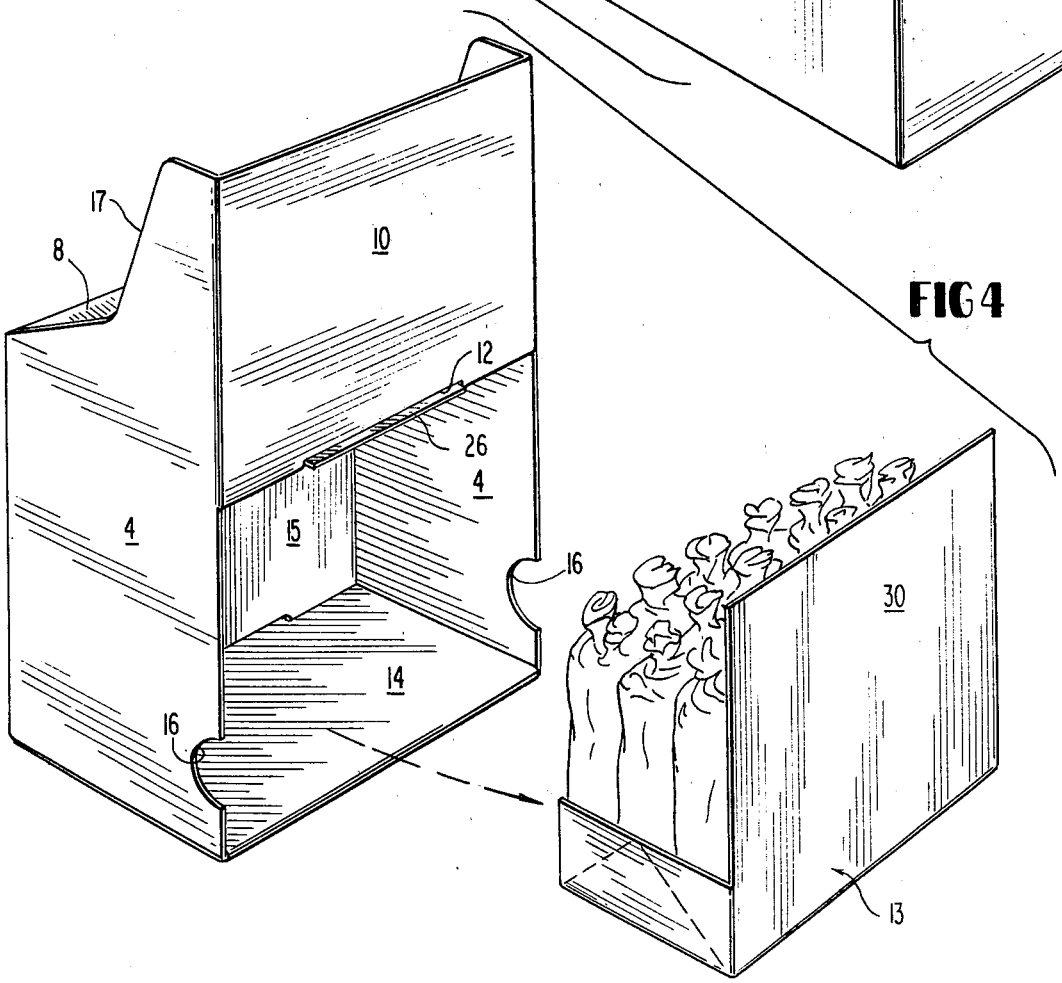
FIG. 4 is a perspective view of the back of the frame illustrating how a tray is stored in the enclosure at the back of the structure.

Referring now to the drawings wherein like reference characters designate like or corresponding parts throughout the several views, there is shown in FIG. 1 a view of the frame 29 with its protective cover 1 in place over tray 5 for storing or shipping. When the package is shipped, it is first wrapped in cellophane to protect its contents. Then, when the frame is about to be put on display, the cellophane wrapper is removed and, as illustrated in FIG. 2, the protective cover 1 is removed from tray 5. FIG. 2 shows the frame as it would be displayed with articles for sale on tray 5. The rear wall 31 of tray 5 lies adjacent and parallel to the rear wall 10 of the frame, as illustrated in FIG. 2. When tray 5 is empty, it is removed from shelf 8, as illustrated in FIG. 3, and is replaced by tray 13 which was stored in the enclosure, as illustrated in FIG. 4. FIGS. 1-3 show a small section of tray 13 at the bottom of the frame where the side wall 4 has been cut away. This cutaway simplifies the removal of tray 13 by allowing the tray to be gripped by its side walls. Referrring to FIG. 4, it can be shown that the rear wall 30 of tray 13 is essentially the same size and shape as the opening of the enclosure within the frame. Thus, when tray 13 is in place within the enclosure, the rear wall 30 of the tray, together with the rear wall 10 of the frame, form a complete wall extending from the bottom to the top of the frame.

More particularly, referring to FIGS. 1 and 2, the side walls 2 of the cover 1 fit in between the side walls 3 of the tray 5 and the walls 4 of the frame 29. The front wall 6 of the cover 1 tucks behind the front wall 7 of the tray 5.

FIG. 3 illustrates the removal of tray 5 from shelf 8. When in place, the tray is supported by the extension 9 and the rear wall 10.

FIGS. 3 and 4 illustrate tab 11 inserted into slot 12. FIG. 4 illustrates the removal of the second tray 13 from the enclosure formed by the display structure base 14, side walls 4 and the vertical wall 15. Semicircular portions of the side wall 4 are cut away at location 16, simplifying the removal of tray 13. Large portions of the side walls 4 are cut away at location 17.

Figure 5:
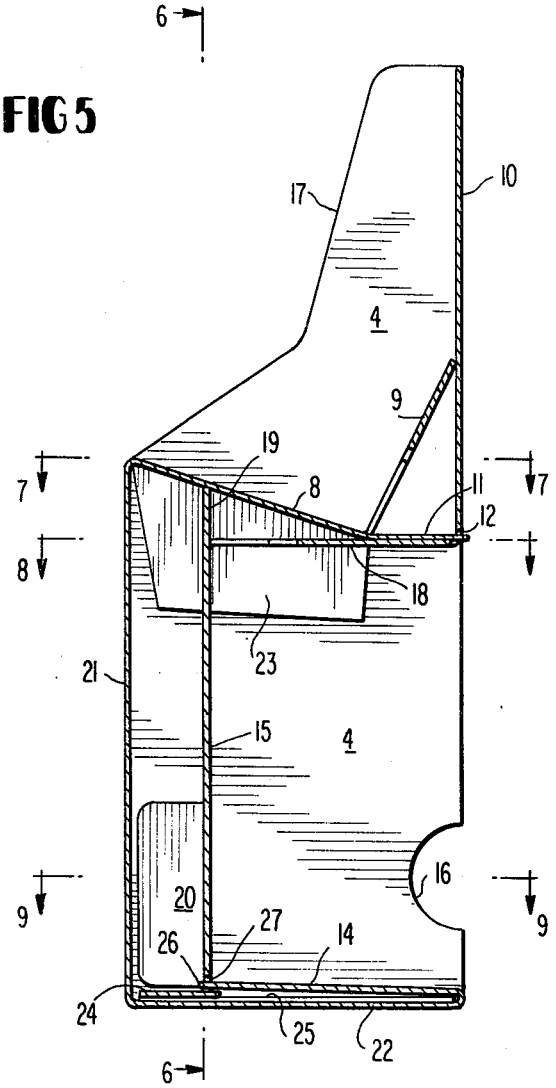
FIG. 5 shows a sectional side view taken along the center of the frame.

In the profile view of FIG. 5, there is shown tabs 23 which are continuous extensions of shelf 8. The vertical support wall 15, the horizontal support 18 and the rear wall 10 are one continuous piece of material folded into three planes. Tab 19 which supports shelf 8 is cut from section 18 and is a continuous extension of wall 15. The front wall 21, the bottom wall 22 and the base 14 are also one continuous piece of material folded into three planes. Tabs 20 and 24 are continuous extensions of supporting wall 15. Between floor 22 and base 14 are tabs 25 which extend horizontally from the side walls 4. There is a small tab 26 that is an extension of base 14 that fits through slot 27 in support wall 15.

Figure 6:
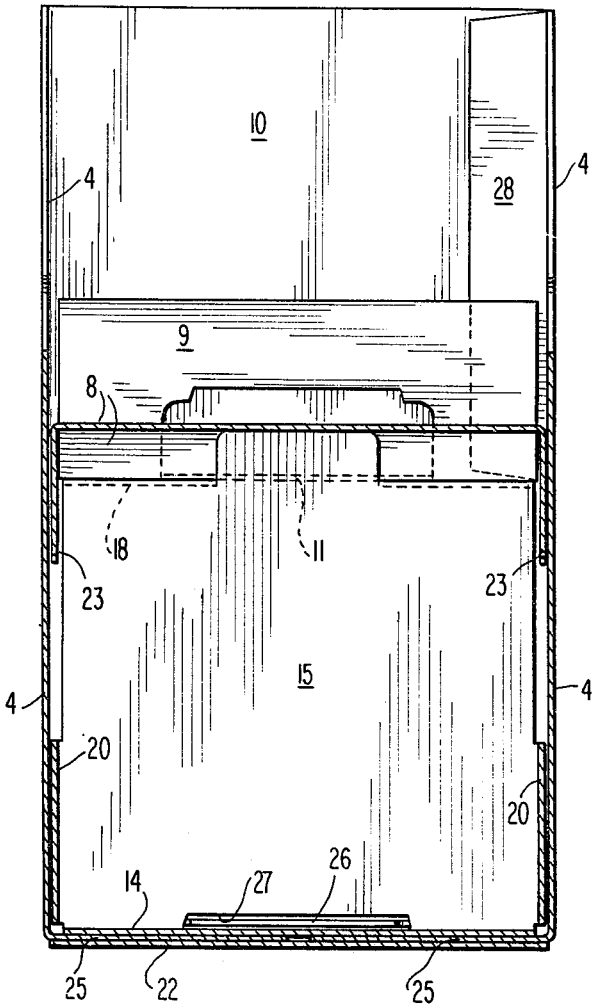
FIG. 6 shows a sectional front view of the frame taken along line 6—6 of FIG. 5.
Figure 7:
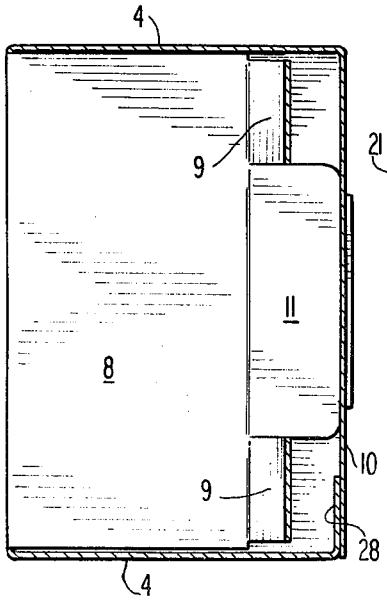
FIG. 7 shows a sectional top view of the frame taken along line 7—7 of FIG. 5.
Figure 8:
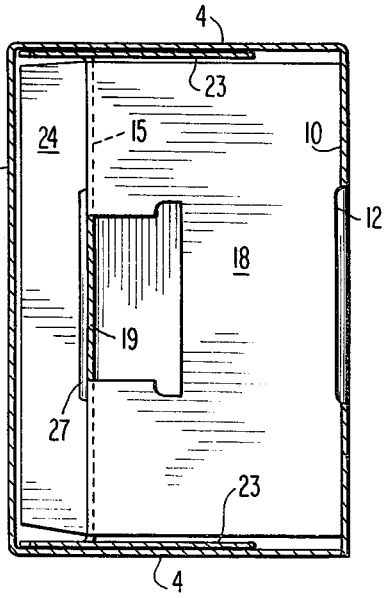
FIG. 8 shows a sectional top view of the frame taken along line 8—8 of FIG. 5.
Figure 9:
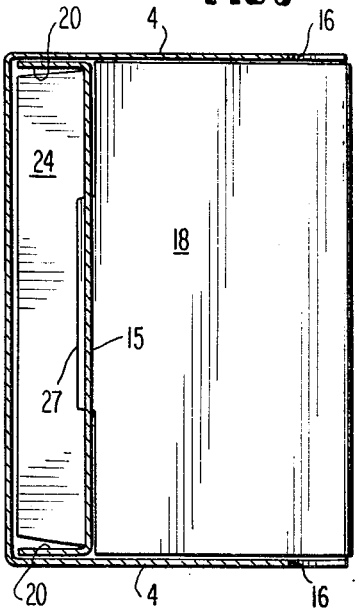
FIG. 9 shows a sectional top view of the frame taken along line 9—9 of FIG. 5.

FIG. 6 shows a front view of the extensions 25 of the side walls 4. Flap 28 is a continuous extension from the right side wall 4 and is glued to the rear wall 10. FIG. 7 shows shelf 8, tab extension 11 and a cross-section of wall 9. Front wall 21 is not tall enough to be shown in the cross-section in FIG. 7 but is included in the cross-sections shown in FIGS. 8 and 9.

Figure 10:
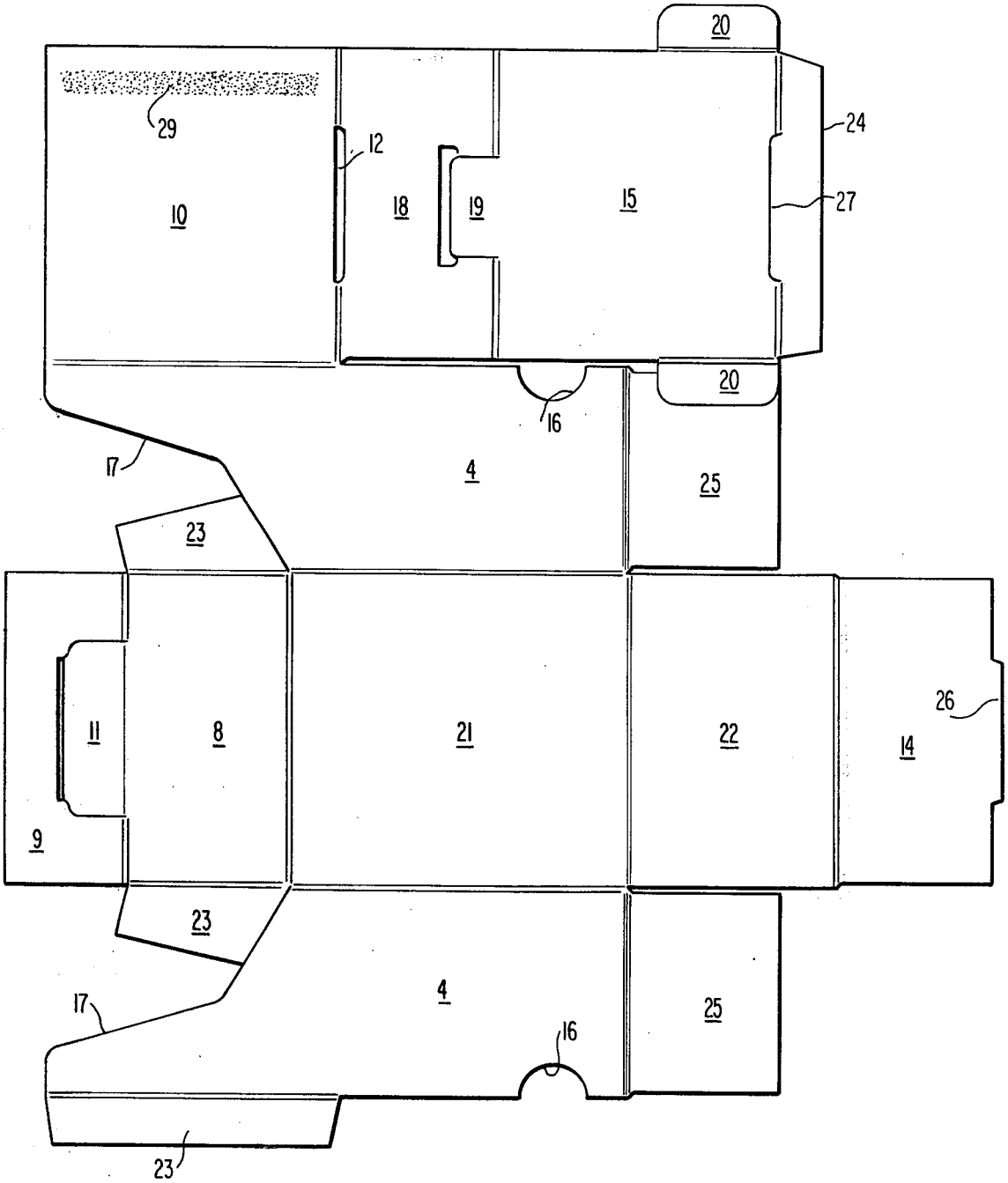
FIG. 10 shows a plan view of the unfolded frame.

The structure is assembled by stamping out the blank shown in the plan view of FIG. 10. It is thus folded on the lines between planes 4-21, 21-4, 4-10 and 28-4 to form a rectangular tube. Flap 28 is then glued onto section 29. Tabs 28 are then folded in, parallel to the side walls 4. Section 9 is then folded out of the container so that it is perpendicular to shelf 8, which is then folded into the frame, and tab 11 is inserted into slot 12. Tabs 20 and 24 are then folded into the container perpendicular to wall 15 and then by folding along the lines between sections 10 and 18 and 18 and 15, section 18 is folded into the container horizontally and section 15 is put into place parallel to the front wall. Flaps 25 are then folded underneath tab 24 and the lower extension 22 of the front wall 21 is folded up, and the final extension 14 of the front wall is folded down into the container and tab 26 is inserted into slot 27. The trays 5 and 13 are then placed in their respective locations, and the cover 1 is put in place over tray 5.

What is claimed is:

1. A device for shipping and displaying articles, said device comprising:

a frame havng front, rear, bottom and side walls connected to each other, said front and side walls having bottom edges lying in the same plane of said bottom wall, said front and rear walls having top edges on the side thereof which is opposite to said bottom wall, the top edge of said front wall lying below the top edge of said rear wall, said frame including a substantially horizontal shelf, supported by said front and rear walls, which is disposed substantially at the same level as the top edge of said front wall, said shelf and said front, bottom and side walls defining an enclosure, said rear wall having a bottom edge spaced from said bottom wall so as to define an opening affording access to said enclosure, two identical trays, one of said trays being disposed on said shelf for diplaying articles upon it and the other tray being stored within said enclosure for subsequent use, each of said trays beng adapted to fit both on said shelf and within said enclosure, whereby the tray stored within said enclosure can be exchanged for the tray disposed on said shelf when the latter is empty.

2. A device as claimed in claim 1, wherein each of said trays has front, bottom, rear and side walls connected to each other, said front and side walls of each tray being lower than said rear wall of each tray, said rear wall of each tray having substantially the same dimensions of the portion of the rear wall of said frame which extends above said shelf.

3. A device as claimed in claim 1, wherein said bottom wall is formed by flaps extending from the front and side walls of said frame.

4. A device as claimed in claim 1, wherein said shelf is an extension of said front wall.

5. A device as claimed in claim 1, wherein said rear wall has an extension which extends substantially horizontally away from said bottom edge of the rear wall to form a support for said shelf.

6. A device as claimed in claim 5, wherein said support of the shelf has an extension on its side opposite to said rear wall, said extension lying in a plane parallel to and spaced apart from said front wall and extending from said support for the shelf to the bottom wall of said frame.

7. A device as claimed in claim 1, wherein said shelf has an extension that is adapted to fit through a slit cut in the rear wall of said frame.

8. A device as claimed in claim 1, wherein said shelf has an extension on its side opposite to said top edge of the front wall, said extension lying in a plane orthogonal to the plane of said shelf.

9. A device as claimed in claim 1, wherein the display shelf is tilted back at a slight angle.

10. A device as claimed in claim 1, wherein the front, side and rear walls are used for printed indicia.

11. A device as claimed in claim 1, wherein the side walls each have a small semicircular portion cut out from the rear edge near the bottom of the wall.

12. A device as claimed in claim 1, wherein said side walls have inclined top edges on the sides thereof which are opposite to said bottom wall, each of said inclined top edges extending from the top edge of said front wall to the top edge of said rear wall.

13. A device as claimed in claim 1, wherein said frame is provided with a protective cover adapted to be disposed upon the tray which fits on said shelf so as to permit shipping and storing.

* * * * *